US006073473A

United States Patent [19]

Ziemek

[11] Patent Number: 6,073,473

[45] **Date of Patent: *Jun. 13, 2000**

[54] DEVICE FOR CORRUGATING TUBES

[75] Inventor: Gerhard Ziemek, Langenhagen, Germany

[73] Assignee: Alcatel, Paris, France

[ * ] Notice: This patent issued on a continued prosecution application filed under 37 CFR 1.53(d), and is subject to the twenty year patent term provisions of 35 U.S.C. 154(a)(2).

[21] Appl. No.: 09/037,748

[22] Filed: Mar. 10, 1998

[30] Foreign Application Priority Data

Mar. 12, 1997 [DE] Germany ..... 197 10 071.6

[51] Int. Cl.[7] ..... B21D 15/06

[52] U.S. Cl. ..... 72/78; 72/370.19

[58] Field of Search ..... 72/77, 78, 194, 72/370.19

[56] References Cited

U.S. PATENT DOCUMENTS

| | | | |
|---|---|---|---|
| 738,933 | 9/1903 | O'Donnell | 72/78 |
| 2,614,607 | 10/1952 | Klein | 72/78 |
| 3,387,477 | 6/1968 | Shupper | 72/78 |
| 3,672,196 | 6/1972 | Levacher et al. | 72/77 |

FOREIGN PATENT DOCUMENTS

| | | |
|---|---|---|
| 893 784 | 10/1953 | Germany . |
| 1 272 865 | 7/1968 | Germany . |
| 21 22 906 B2 | 11/1972 | Germany . |
| 2 309 215 | 10/1973 | Germany . |

*Primary Examiner*—Lowell A. Larson
*Attorney, Agent, or Firm*—Ware, Fressola, Van der Sluys & Adolphson LLP

[57] ABSTRACT

In an apparatus for continuous corrugation of walls of tubes or tubular elements, especially cable components, at least one corrugating wheel, rotatable about its own axis, also rotates about the tubular element to be corrugated. In addition to a drive (15) for the rotation of the at least one corrugating wheel (11) about the tubular element (5) to be corrugated, there is provided a speed-controllable drive (16) for the rotation of the at least one corrugating wheel about its own axis.

8 Claims, 4 Drawing Sheets

DEVICE FOR CORRUGATING TUBES

BACKGROUND OF THE INVENTION

1. Technical Field

The invention concerns a device for the continuous corrugation of tubes or tube-shaped elements, particularly cable components, with at least one corrugating wheel which rotates around its own axis and in addition rotates around the tube-shaped element to be corrugated.

2. Description of the Prior Art

To corrugate welded metal tubes or cable elements (cable jackets or outer conductors of coaxial cables)—hereinafter called tubes—it is known to guide a smooth tube, preferably a smooth tube with a longitudinally welded seam, through a bushing, where one or several corrugating tools engage the smooth tube immediately behind the bushing. The corrugating tools comprise wheels in which sliding blocks with beveled ends are located at defined distances. The corrugation takes place by rotating the corrugating wheels around the tube to be corrugated, and simultaneously rotating them around their own axis in accordance with the forward travel speed of the tube to be corrugated.

Devices for producing a corrugation by using sliding blocks or roller wheels are known from the German patent no. 893 784, the German patent specifications 1 272 865, 21 22 906 and 2 309 215 but which, when starting with a given diameter of a smooth tube, are only able to produce a corrugated tube whose maximum diameter is the same as that of the smooth tube.

SUMMARY OF THE INVENTION

The object of the invention is to create a device which makes possible the production of a corrugated tube whose diameter is larger than the starting diameter of the smooth tube. The invention achieves this object in that, in addition to the drive for rotating the corrugating wheel around the tube-shaped element to be corrugated, a speed controllable drive is provided for the rotation around its own axis.

A continuous adjustability of the corrugating wheel rpm, which may be higher or lower than the rpm which corresponds to the advancing travel of the tube to be corrugated, allows the material of the smooth tube being corrugated to be pressed against the sliding blocks of the corrugating wheels, so that the material of the tube can be pushed to a larger outside diameter. Since the linear advancing travel speed v of the smooth tube, and the continuously adjustable rpm $n_1$of the rotor in conjunction with the continuously adjustable rpm $n_2$ of the corrugating wheel around its own axis, provide the possibility of optimizing the shape of the corrugation, the shape of the tube corrugation which is desirable for mechanical or electrical reasons can be adjusted without any difficulties. The drive of the corrugating wheels around their own axis is preferably transmitted by means of a planetary gear. The planetary wheel floats inside a rotor which supports the corrugating wheels and rotates around the tube to be corrugated. It is furthermore advantageous to arrange all rotating parts on a single tube-shaped cantilever beam and to securely flange one side of the latter against a stationary tool support. The support of the rotating parts on the stationary carrying tube can be accomplished by means of concentrically arranged hollow shafts.

According to a particularly useful configuration of the idea of the invention, the lengths of the sliding blocks are beveled at an angle of about 0.5° to 10°, which causes the dipping to the desired depth of the corrugation not to occur suddenly, but through a slightly conical transition.

The same purpose is served by a further advantageous feature of the invention, according to which the sliding blocks, which are made of a wear-resistant material, have a conical cross section and penetrate the material to be corrugated in a wedge-type manner. The diverging change in thickness corresponds to a wedge angle of about 0.5° to 2°.

The ability to axially shift the corrugating wheels on their drive shafts proved to be a particular advantage. In this way, for given tube measurements, different penetration depths in the tube wall can be established for the sliding blocks, which push the tube material in the longitudinal direction.

The invention will be fully understood when reference is made to the following detailed description taken in conjunction with the accompanying drawings.

DETAILED DESCRIPTION OF THE INVENTION

Figure 1:
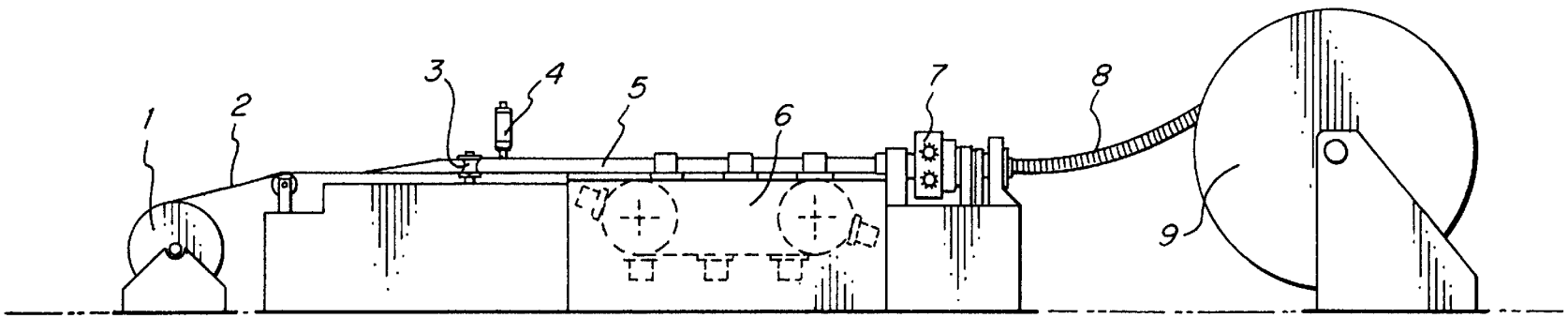
FIG. 1 is a schematic view of an installation for producing a corrugated tube by means of the corrugating device.

The metal strip 2 to be formed is drawn from a spool 1 and is cut to size between two not illustrated pairs of circular knives, and during the shaping stage is formed into a slotted tube with the help of a pair of rollers 3. A welding installation 4 for arc or laser welding is used to weld the edges of the slotted tube to each other. The closed but still smooth tube 5 is gripped by the puller 6, for example a collet chuck, and fed to the corrugating device 7. The corrugated tube 8 running out of the corrugating device 7 can be wound on a conventional cable drum 9.

Figure 2:
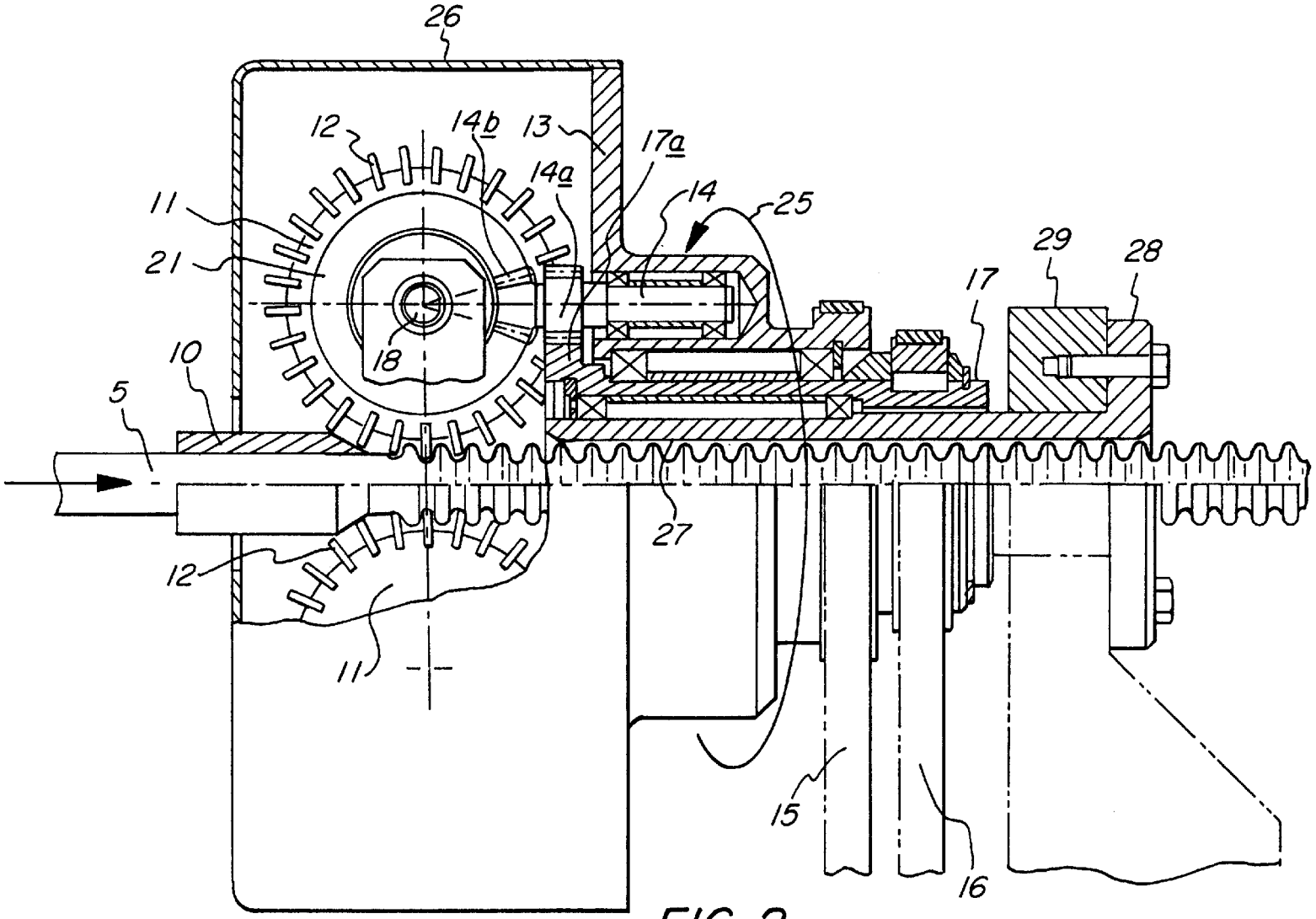
FIG. 2 is a partial longitudinal cross sectional view of the corrugating device for producing a corrugated tube with a diameter of <30 mm.
Figure 4:
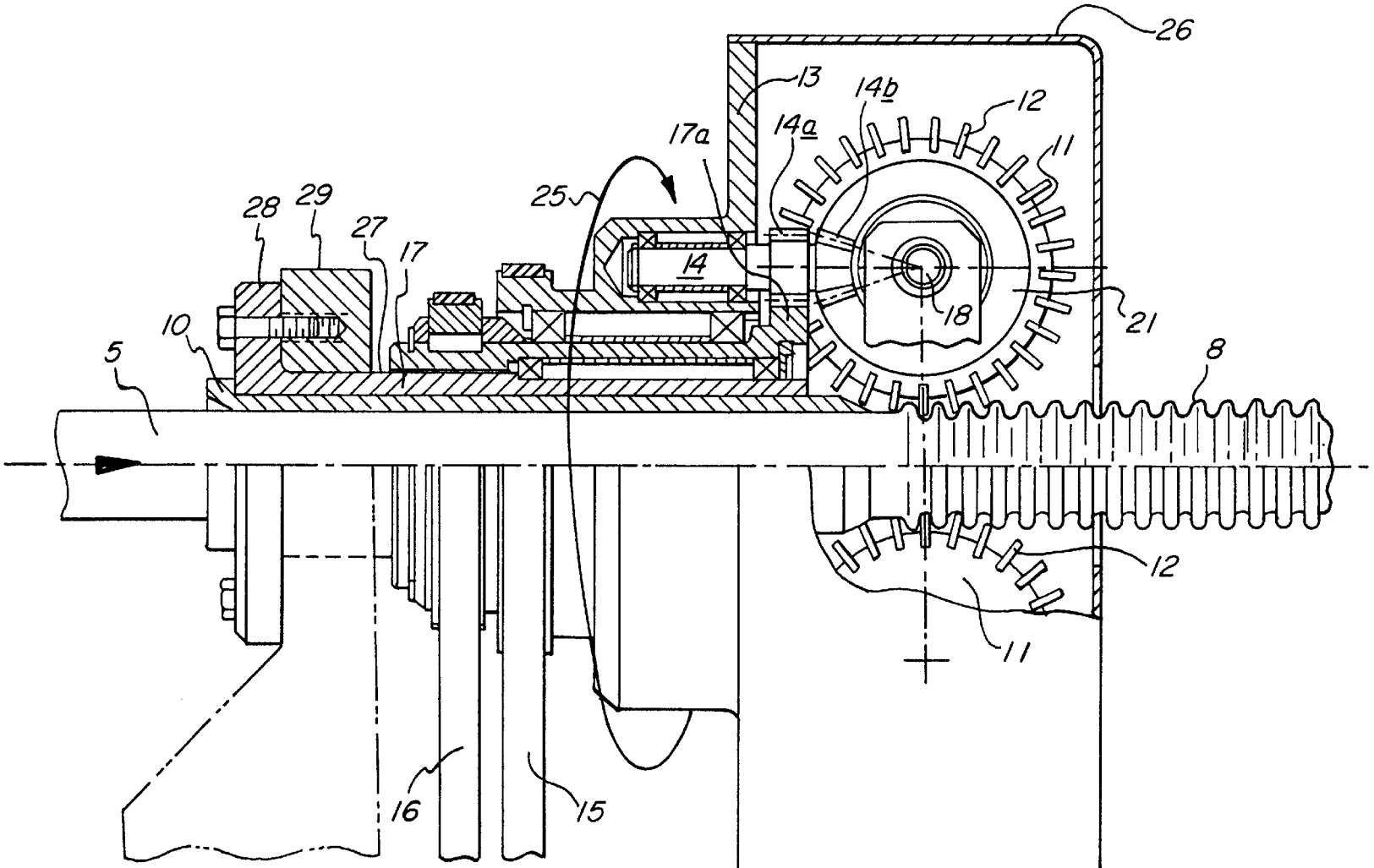
FIG. 4 is a partial longitudinal cross sectional view of the corrugating device for corrugated tubes having a diameter that exceeds 30 mm.

As illustrated in FIGS. 2 and 4, the entire corrugating device 7 can be aligned in different ways with reference to the advancing direction of the tube to be corrugated. When pushing the material of tube diameters under 30 mm, it is advantageous if the distance between the collet chuck 6 in the chuck puller and the corrugating device 7 is kept as short as possible, so that the thin tube does not buckle under the pushing pressure.

With a tube diameter above 30 mm, there is no danger of the tube buckling under the pushing pressure. For that reason the installation, with reference to the advancing direction of the tube, can be assembled turned around 180°. With the corrugating device 7 thus positioned, the corrugated tube 8 can exit directly out of the corrugating device 7.

FIGS. 2 and 4 schematically enlarge the corrugating device. The smooth welded tube entering from the arrow direction is designated by 5, and is guided through the corrugation bushing 10 to the corrugating wheels 11. At its outlet end, the corrugation bushing 10 is conical, so that it can extend as closely as possible to the corrugating wheels 11. This positions the tube 5 to be corrugated extremely precisely. The hard metal sliding blocks 12 are inserted and distributed uniformly around the perimeter of the corrugating wheels 11. The corrugating wheels 11 are set in a rotor 13, which moves them around the tube to be corrugated in the direction of arrow 25. The rotor 13 is driven by a drive 15 which is not illustrated in detail.

The rotor 13 contains a floating idler shaft 14. The latter therefore rotates around the tube 5 to be corrugated like the corrugating wheels 11. At its outer end, the idler shaft 14 has a spur gear (or pinion wheel) 14*a* and a bevel gear pinion 14*b*. The bevel gear pinion 14*b* engages a bevel gear 21 which sits on a multi-grooved shaft 18. The multi-grooved shaft 18 simultaneously carries the corrugating wheel 11. Via a hollow shaft 17, a drive 16 which is not illustrated in detail drives a spur gear 17*a*, which meshes with the spur gear 14*a*. In this way, the torque is transmitted to the bevel gear 21 of corrugating wheel 11 via the bevel gear pinion 14*b*. Thus, the spur gear 17*a* acts on the idler shaft like the sun wheel of a planetary gear, by using the spur gear 14*a* as a planetary wheel. The ratio of the rotor rpm to the spur gear rpm is firmly specified during the start-up. Once the production speed has been reached, the fine adjustment can be made to optimize the corrugation.

Figure 3:
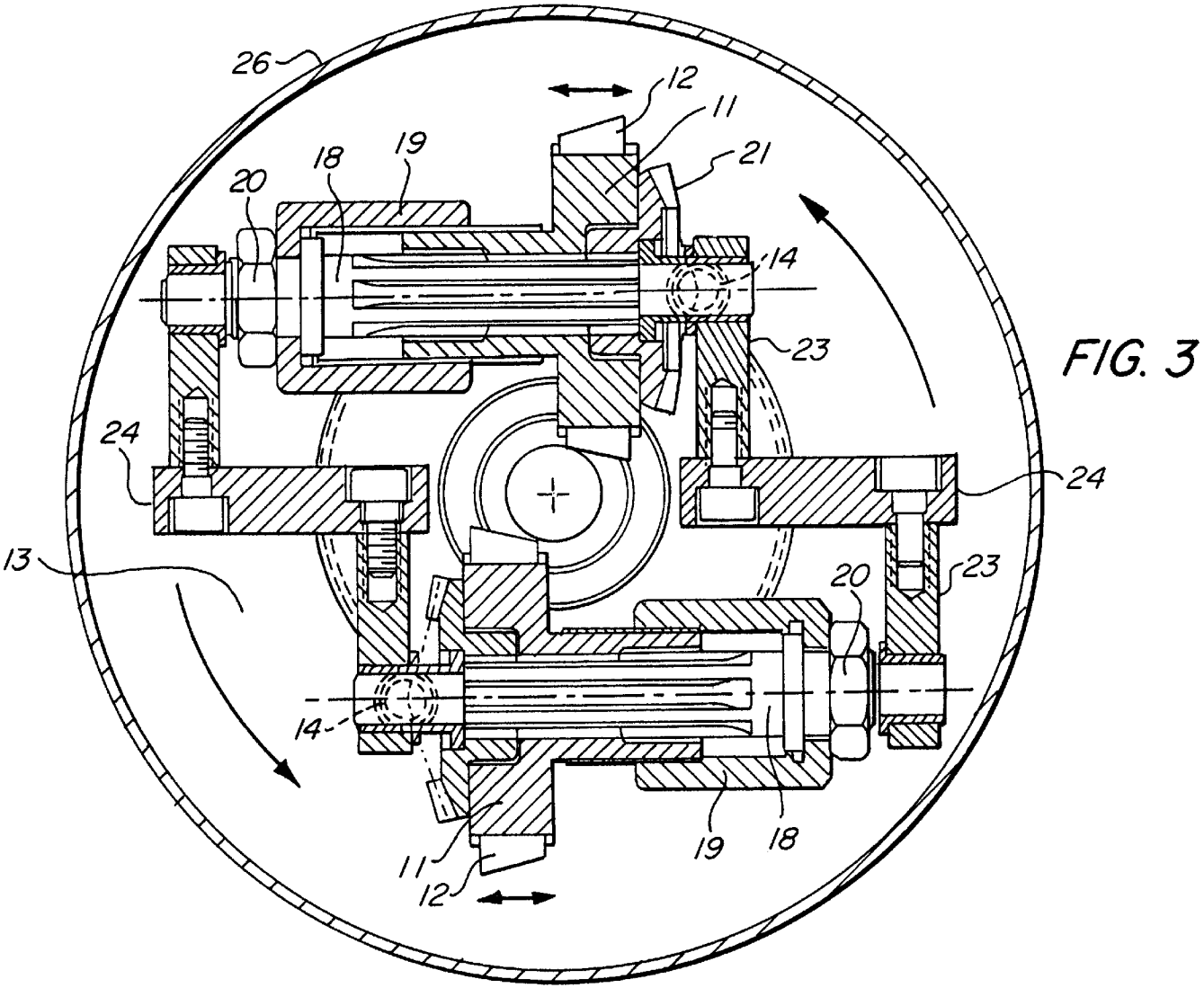
FIG. 3 is a cross sectional view of the corrugating device in the area of the rotating axes of the corrugating wheels.

FIG. 3 schematically illustrates the corrugating wheel 11 with its adjustment possibilities. The bevel gear 21 connects the multi-grooved shaft 18 to the transmission 14, 14*a*, 14*b* and is driven thereby. The corrugating wheel 11 can be axially shifted on the multi-grooved shaft 18. A clamping nut 19 is used for the adjustment. A locknut 20 is drawn against the clamping nut 19 to secure the adjusted position. Since imbalances occur because of the shifting of the corrugating wheel 11, a not illustrated counterbalance is provided.

The rotor 13 carries two corrugating wheels 11 in the illustrated embodiment. Their multi-grooved shafts 18 are supported by brackets 23 and 24, which are bolted to each other and connected to the rotor 13. The connecting element is not illustrated for reasons of better clarity. The cover of the rotor is designated by 26.

The entire device with its rotating parts, namely the rotor 13, transmission 14, 14*a*, 14*b*, corrugating wheels 11 and hollow shaft 17, are installed on a tube-shaped protruding carrier 27. The outermost end of the carrier has a flange 28 whereby it is securely bolted to a stationary tool support 29.

The corrugating device in FIG. 4 only differs from the one in FIG. 2 in that the tube-shaped carrier 27 is designed for corrugating a tube with a diameter >30 mm, thus it has a larger clearance diameter into which the corrugation bushing 10 is drawn. This allows the arrangement to be turned 180° from the position of the device in FIG. 2, so that the corrugated part of the tube can exit from the device immediately and does not need to be routed through the support tube 27. Accordingly the rotation of the corrugating wheels 11 is in the opposite direction.

The preferred embodiment described above admirably achieves the objects of the invention. However, it will be appreciated that departures can be made by those skilled in the art without departing from the spirit and scope of the invention which is limited only by the following claims.

What is claimed is:

1. A device for producing circumferentially continuous corrugations in the wall of a tube-shaped element, comprising:

(a) at least one corrugating wheel which rotates on its own axis and additionally revolves around the tube-shaped element to be corrugated;

(b) a rotor which carries the at least one corrugating wheel and revolves said wheel around the tube-shaped element to be corrugated;

(c) a planetary wheel mounted in said rotor and cooperating with a planetary gear which drives said at least one corrugating wheel; and (d) a speed-controllable drive which rotates the at least one corrugating wheel on its own axis at a selected one of a plurality of different rpm speeds, whereby said corrugating wheel can, if desired, push material of an initially smooth tube to a larger diameter than that of said smooth tube, thereby optimizing a resulting shape of said corrugations to match an intended use of a corrugated tube produced by said device.

2. A device as claimed in claim 1, wherein the at least one corrugating wheel is two paired corrugating wheels, which are equipped with sliding blocks.

3. A device as claimed in claim 1, wherein the at least one corrugating wheel is relatively adjustable in reference to the tube-shaped element to be corrugated to adjust corrugation depth in the tube-shaped element.

4. A device as claimed in claim 1, wherein the at least one corrugating wheel is located on a multi-grooved shaft, on which the at least one corrugating wheel can be axially shifted by means of a drive screw and secured with a locknut.

5. A device as claimed in claim 1, wherein the at least one corrugating wheel has sliding blocks with edges, the edges of the sliding blocks, which penetrate into the tube-shaped element to be corrugated, are beveled in a range of about 0.5° to 10°, forward ends of the sliding blocks, which penetrate first into the tube-shaped element, are shorter than rear ends of the sliding blocks.

6. A device as claimed in claim 5, wherein the sliding blocks thicken at an angle in a range of about 0.5° to 2°.

7. A device as claimed in claim 1, wherein, for a diameter of the tube-shaped element to be corrugated in a range of about 30 mm and under, the at least one corrugating wheel is arranged before the drive for rotating the at least one corrugating wheel and the speed controllable drive with reference to an advancing device of the tube-shaped element to be corrugated.

8. A device as claimed in claim 1, wherein the at least one corrugated wheel, the drive for rotating the at least one corrugating wheel and the speed controllable drive are arranged on a tube-shaped cantilever beam, one end of which is securely flanged to a stationary tool support.

* * * * *